US006604891B1

(12) United States Patent
Wurster

(10) Patent No.: US 6,604,891 B1
(45) Date of Patent: Aug. 12, 2003

(54) RETAINING WALL DRAINAGE UNIT

(76) Inventor: Daryl Wurster, 102 Ponders Ray La., Greenville, SC (US) 29615

( * ) Notice: Subject to any disclaimer, the term of this patent is extended or adjusted under 35 U.S.C. 154(b) by 0 days.

(21) Appl. No.: 10/274,164

(22) Filed: Oct. 18, 2002

(51) Int. Cl.[7] ..... E02D 29/02

(52) U.S. Cl. ..... 405/284; 405/262; 405/285; 405/286; 52/169.5

(58) Field of Search ..... 405/262, 284, 405/285, 286, 287, 43, 45, 50; 52/169.5, 302.7, 320.8, 302.3, 302.1

(56) References Cited

U.S. PATENT DOCUMENTS

| | | | | | |
|---|---|---|---|---|---|
| 4,271,648 | A | * | 6/1981 | Johnson | 52/169.5 |
| 4,666,334 | A | * | 5/1987 | Karaus | 405/284 |
| 4,840,515 | A | | 6/1989 | Freese | 405/45 |
| 4,943,185 | A | | 7/1990 | McGuckin et al. | 405/45 |
| 4,952,097 | A | * | 8/1990 | Kulchin | 405/262 |
| 5,036,924 | A | * | 8/1991 | Carino | 169/70 |
| 5,425,600 | A | * | 6/1995 | Gordon | 405/284 |
| 5,458,436 | A | * | 10/1995 | Plowman et al. | 405/43 |
| 5,511,622 | A | * | 4/1996 | Thompson | 52/220.8 |
| 5,560,163 | A | * | 10/1996 | Carlton | 52/169.5 |
| 5,765,970 | A | * | 6/1998 | Fox | 405/284 |
| 6,280,117 | B1 | | 8/2001 | Obermeyer et al. | 405/119 |

* cited by examiner

*Primary Examiner*—Heather Shackelford
*Assistant Examiner*—Frederick L. Lagman
(74) *Attorney, Agent, or Firm*—McNair Law Firm, P.A.

(57) ABSTRACT

A drainage unit for an earth retaining wall system to provide water drainage from a vertical drainage sheet through the retaining wall to reduce hydrostatic pressure on the retaining wall. The drainage unit comprises a drainage collector for attaching to a sheet drain to collect and discharge water that flows into the sheet drain. A drain hub is included in the drainage collector for being mounted in fluid communication with the sheet drain to receive and channel water for discharge. A discharge extension is included in the drainage collector that extends from the drain hub for discharging water through the retaining wall. A retainer is provided for engaging the discharge extension after passing through the sheet drain and securing the drain hub and discharge extension in position on the sheet drain.

20 Claims, 3 Drawing Sheets

RETAINING WALL DRAINAGE UNIT

FIELD OF THE INVENTION

The present invention relates to subsurface drainage systems, and more particularly, to a drainage unit for an earth retaining wall system that channels subsurface water away from behind the retaining wall to relieve hydrostatic pressure that can damage the wall.

BACKGROUND OF THE INVENTION

Proper drainage is an important consideration in the design and construction of earth retaining walls. In the absence of proper drainage, the water level behind a retaining wall can rise and create substantial hydrostatic pressure, which can result in severe structural damage to the retaining wall, and even cause the wall to fail.

Recently, vertical drainage sheets, commonly known as sheet drains or drainboards, have been developed to provide proper drainage for subsurface water behind a retaining wall. These sheet drains are designed to be attached to the buried face of the retaining wall to permit ground water to flow down along the face of the retaining wall inside the sheet drain to a drainage pipe located at the foundation of the wall, which channels water around the sides of the wall. Basically, the sheet drains comprise a shaped core that allows vertical passage for the flow of water down the face of the wall, and a filter fabric or screen cover surrounding the shaped core to prevent soil and other debris from entering the core and possibly clogging the drainage system.

The sheet drains are designed to be used with a perforated drainage pipe positioned at the lower end of the sheet drain at the base of the retaining wall for conveying ground water away from the wall to relieve the hydrostatic pressure. Examples of such drainage systems can be found in U.S. Pat. Nos. 4,943,185 and 4,840,515. The drainage systems disclosed in these patents, however, are focused on the construction of the sheet drains. The patents do not address the problems associated with diverting drainage water from the sheet drain directly through a retaining wall.

Typically, in order to accomplish the task of channeling subsurface drainage water through a retaining wall, a drainage pipe is often taped or otherwise tacked in place against the exterior fabric surface of a sheet drain while the retaining wall is formed, commonly using a shotcreting process. Taping or tacking the drainage pipe to the exterior of the sheet drain, however, does not provide a sturdy connection capable of withstanding the jostling that occurs during the construction of the retaining wall. As a result, the drainage pipes often become dislodged from the sheet drains, leading to delays and problems in the construction of the retaining wall. Furthermore, taping or tacking the drainage pipe to the sheet drain does not provide a tight seal between the sheet drain exterior fabric and drainage pipe. A tight seal is required to preventing soil and other debris from entering the drainage pipe and clogging up the drainage system. An additional problem with simply taping a drainage pipe to the sheet drain exterior is that only a small water collection area is created for receiving water from the sheet drain and channeling it through the retaining wall. A standard drainage pipe is three inches in diameter, and unless the water enters this three inch area, it will simply pass through the sheet drain and collect at the retaining wall foundation.

Another type of drainage system can be found in U.S. Pat. No. 6,280,117, which discloses a universal drain fitting for channeling subsurface water flows away from a retaining wall. The drain fitting, however, is designed to attach to the outer edges of a sheet drain in order to collect water that flows into the sheet drain. This limited ability of the drain fitting to attach only to the outer edges of the sheet drain creates a substantial impediment when channeling water directly through the retaining wall, as the height of the drainage pipe passing through the wall is often required to be positioned above the foundation of the retaining wall along the face of the sheet drain. Additionally, the drain fitting also requires tape to attach the drain fitting in position on the sheet drain. As noted above, tape is insufficient for securing or sealing a drainage pipe to a sheet drain when constructing a retaining wall around the drainage pipe.

Accordingly, it is an object of the present invention to provide a drainage unit for collecting water that enters a sheet drain and channeling the water into a discharge pipe that extends through a retaining wall to relieve hydrostatic pressure.

It is another object of the present invention to provide a drainage unit that may be positioned at any location on a sheet drain to collect and channel subsurface water through the retaining wall.

It is another object of the present invention to provide a drainage unit with a strong connection to the sheet drain so that the drainage unit cannot be dislodged from its position on the sheet drain during construction of the retaining wall.

It is another object of the present invention to provide a tight seal between the drainage unit and fabric of the sheet drain to prevent soil and debris from entering the drainage unit and clogging the drainage unit.

It is another object of the present invention to provide a drainage unit that channels water in the sheet drain from an area greater than the diameter of the drainage pipe to increase drainage capacity.

It is another object of the present invention to provide a drainage unit in fluid communication with the shaped core of a sheet drain to increase the ability to collect subsurface fluid flows from the sheet drain.

SUMMARY OF THE INVENTION

The above objectives are accomplished according to the present invention by providing a drainage unit for an earth retaining wall system to provide water drainage from a vertical drainage sheet through the retaining wall to reduce hydrostatic pressure on the retaining wall. The drainage unit comprises a drainage collector for attaching to a sheet drain to collect and discharge water that flows into the sheet drain. A drain hub is included in the drainage collector for being mounted in fluid communication with the sheet drain to receive water from the sheet drain and channel the water for discharge. A discharge extension is included in the drainage collector that extends from the drain hub for discharging water from the sheet drain flowing through the drain hub. The discharge extension is in fluid communication with the drain hub for discharging the water through the retaining wall. A retainer having a discharge opening is provided for engaging the discharge extension after passing through the sheet drain. The retainer secures the drain hub and discharge extension in position on the sheet drain to prevent them from being dislodged during construction of the retaining wall.

The drainage collector includes a front sealing ring for engaging a front exterior side of the sheet drain to restrict soil and other debris from entering the drainage collector. Advantageously, the retainer includes a rear sealing ring for engaging a rear exterior side of the sheet drain to restrict soil and debris from entering the drainage collector. In this construction and arrangement, soil, rocks, silt, and other matter cannot enter the drainage unit to clog the passage of water from the sheet drain to the discharge extension.

In the preferred embodiment, the front sealing ring and the rear sealing ring have a diameter greater than the drain hub to create a fluid collection chamber on the front and rear exterior sides of the sheet drain surrounding the drain hub so that an increased area of water collection is provided for channeling water into the drain hub for discharge through the retaining wall.

A plurality of fluid channels are included in the drain hub for channeling water collected from the sheet drain and the fluid collection chambers into the drain hub. Preferably, the fluid channels-comprise an extended slot formed in the drain hub that creates an opening in the drain hub having a slot length greater than a thickness of the sheet drain so that water located within the fluid collection chambers around the outside of the sheet drain is channeled through said extended slots into the drain hub.

Accordingly, a drainage unit is provided that is firmly attached to a sheet drain to prevent separation of the drainage unit from the sheet drain during construction of the retaining wall, and which relieves hydrostatic pressure by channeling water from behind the retaining wall through the retaining wall.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
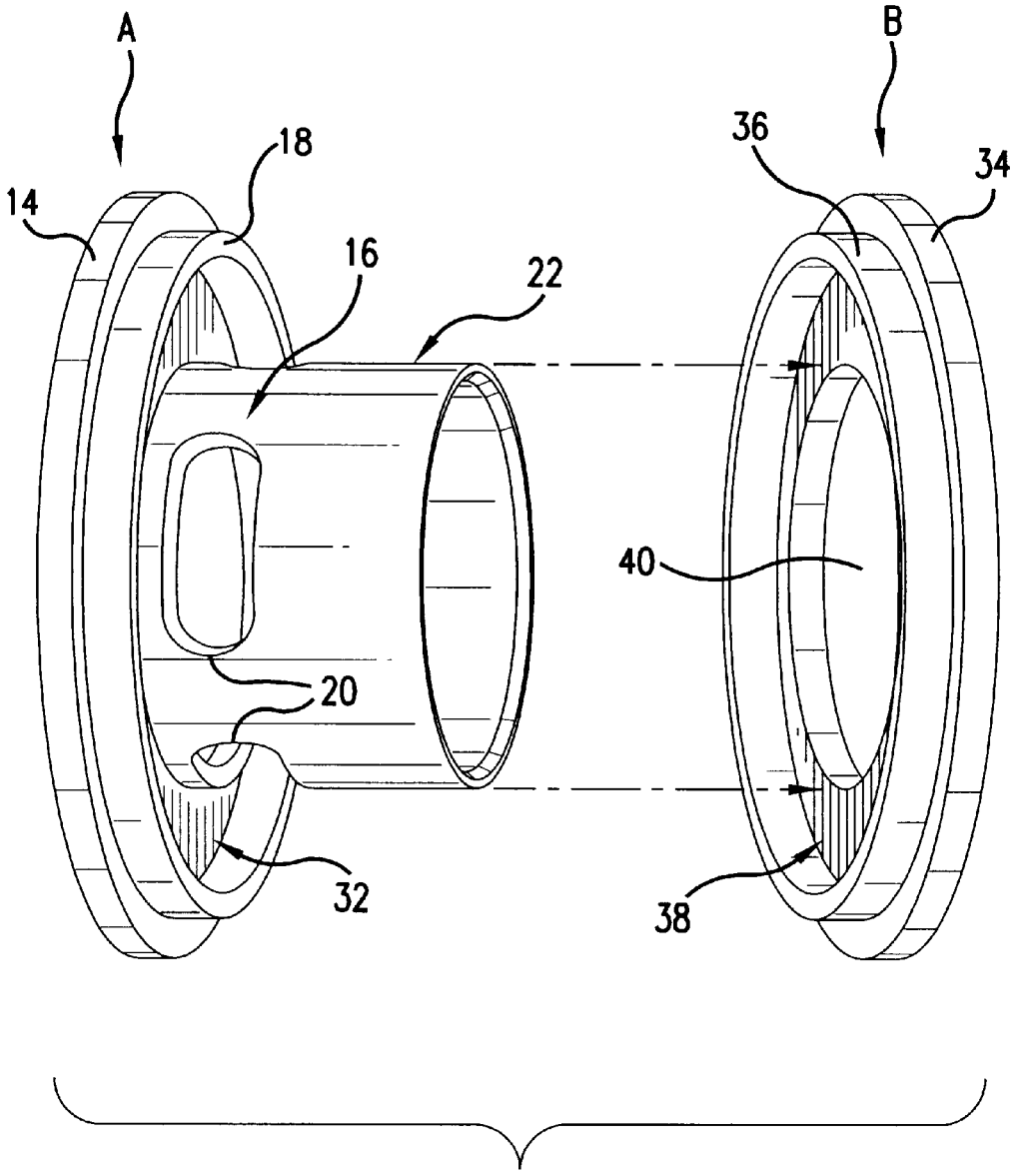
FIG. 1 shows an exploded perspective view of the drainage unit according to the invention.
Figure 3:
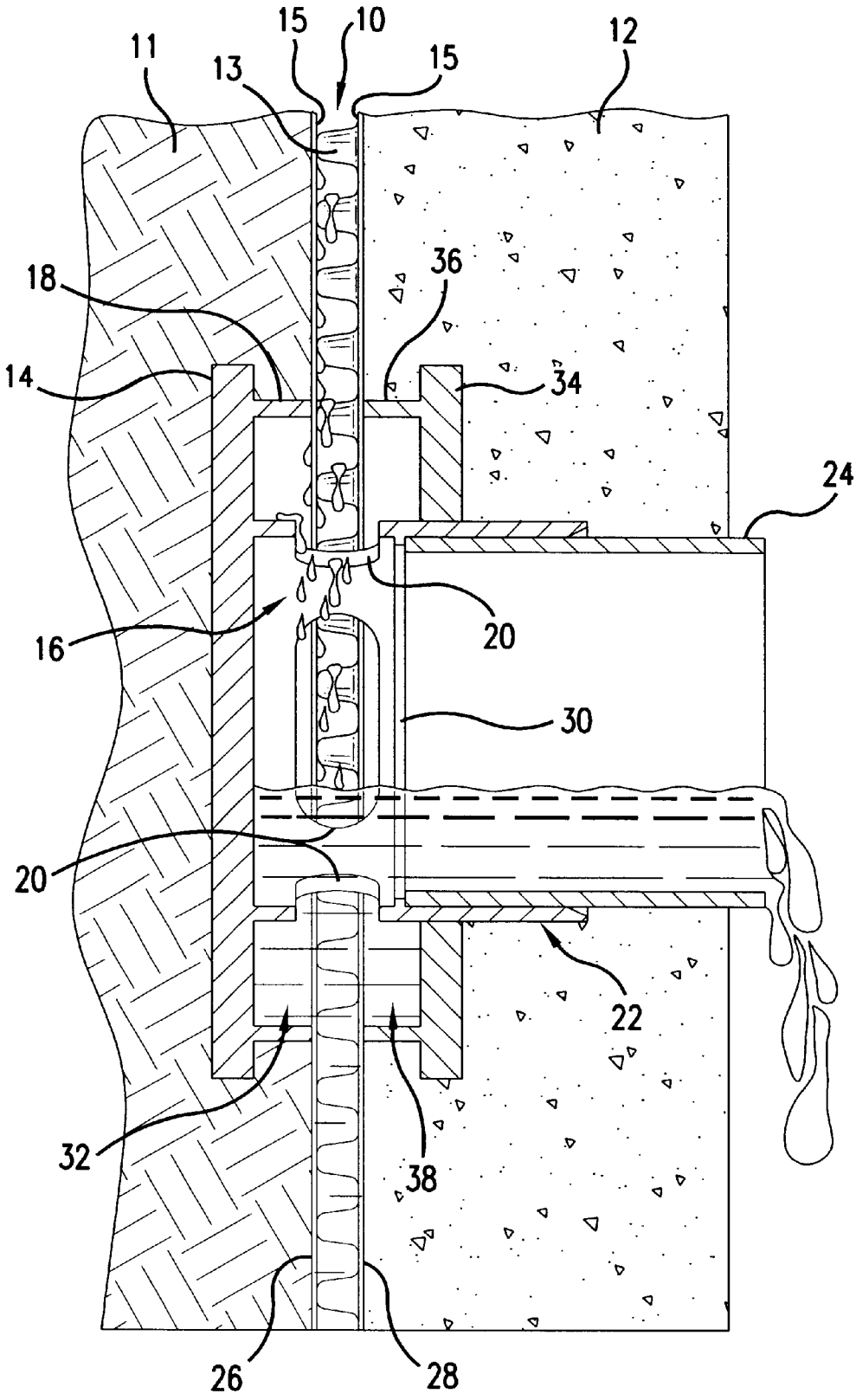
FIG. 3 shows a cross-section of the drainage unit in position on a sheet drain and extending through a retaining wall according to the invention.

Referring to the drawings, the invention will now be described in more detail. As shown in FIG. 1, the retaining wall drainage unit is comprised of two main parts, a drainage collector, designated generally as A, for collecting subsurface water flows, and a retainer, designated generally as B, for securing the drainage collector in place on a sheet drain, designated generally as 10 (FIG. 3). As shown in FIG. 3, sheet drain 10 is positioned vertically along the face of a retaining wall 12 and then covered with soil that is backfilled against the retaining wall. Typically the sheet drain includes a shaped plastic core 13 covered by a filter fabric 15 that allow water to pass into the shaped core, while preventing soil and other debris from entering. The sheet drain provides a drainage barrier between the soil and the retaining wall to prevent erosion of the soil while relieving hydrostatic pressure that may buildup behind the wall. Typically, the drainage unit attaches to a lower portion of the sheet drain near the retaining wall foundation to collect water that flows from soil 11 into the sheet drain and down the face of the retaining wall. Placing the drainage unit low on the sheet drain prevents water levels from rising behind the retaining wall. Accordingly, the drainage collector then channels the water from the sheet drain through retaining wall 12 to relieve hydrostatic pressure that can buildup behind the retaining wall without proper drainage.

Preferably, the drainage unit is formed from a lightweight durable plastic material such as polypropylene or polyethylene, but may be formed from any durable material capable of withstanding the corrosive effects of water and other reactive chemical agents.

The drainage collector includes a front flange disc 14 that carries a drain hub, designated generally as 16, for being inserted into the sheet drain. Drain hub 16 is mounted in fluid communication with sheet drain 10 to collect and channel water from the drainage collector and the sheet drain through retaining wall 12. Drain hub 16 is cylindrical in shape with a preferred diameter of approximately 3" for draining water from behind most retaining walls. It is to be understood that the drainage unit can be formed to any size sufficient to meet required drainage needs, and that a 3" diameter for the drain hub is for illustrative purpose of the preferred embodiment only.

The drain hub includes a plurality of fluid channels 20 for channeling water from the sheet drain into drain hub 16. Each of the fluid channels comprise a generally oval shaped extended slot formed in the drain hub that aligns with the sheet drain so that the drain hub and sheet drain are in fluid communication. Preferably, fluid channels 20 are created to form openings in the drain hub having a slot length greater than the thickness of the sheet drain so that water located around the outside of the sheet drain in fluid collection chambers 32 and 38, discussed in detail below, allow the water to channel into the drain hub for discharge through the retaining wall.

The drainage collector also includes a discharge extension, designated generally as 22, that extends generally horizontally from drain hub 16 through the sheet drain and into an opening in the retaining wall to discharge water collected from the sheet drain entirely through the retaining wall. Referring to FIG. 1, discharge extension 22 is the same diameter and cylindrical pipe shape as drain hub 16 and is in fluid communication with the drain hub for discharging water. Discharge extension 22 can be a single integrated pipe section with drain hub 16 that extends completely through the retaining wall. This embodiment completely eliminates the possibility of the drainage unit becoming dislodged from the sheet drain during construction of the retaining wall. Referring to FIG. 3, alternatively, discharge extension 22 can be adapted to connected to a separate discharge pipe 24 that extends through the retaining wall.

The drainage collector also includes a front seating ring 18 carried by front flange disc 14 that engages a front exterior side 26 of the sheet drain to restrict soil and debris from entering the drainage collector and clogging the unit. Front sealing ring 18 extends horizontally from front flange disc 14 to space the disc from the front exterior side of the sheet drain in order to create a front fluid collection chamber, designated generally as 32, around the drain hub on the exterior side of the sheet drain. This allows water which flows back out of the sheet drain to still be collected by the drain hub and channeled into the drain hub for discharge. As discussed above, fluid channels 20 extend beyond the thickness of the sheet drain to channel water from the fluid collection chamber into the drain hub. As such, drain hub 16 receives water directly from the sheet drain with which it is in fluid communication, and also from the fluid collection chamber 32 that channels water into the drain hub through the fluid channels that would otherwise flow back into the surrounding soil 11 and create hydrostatic pressure.

Figure 2:
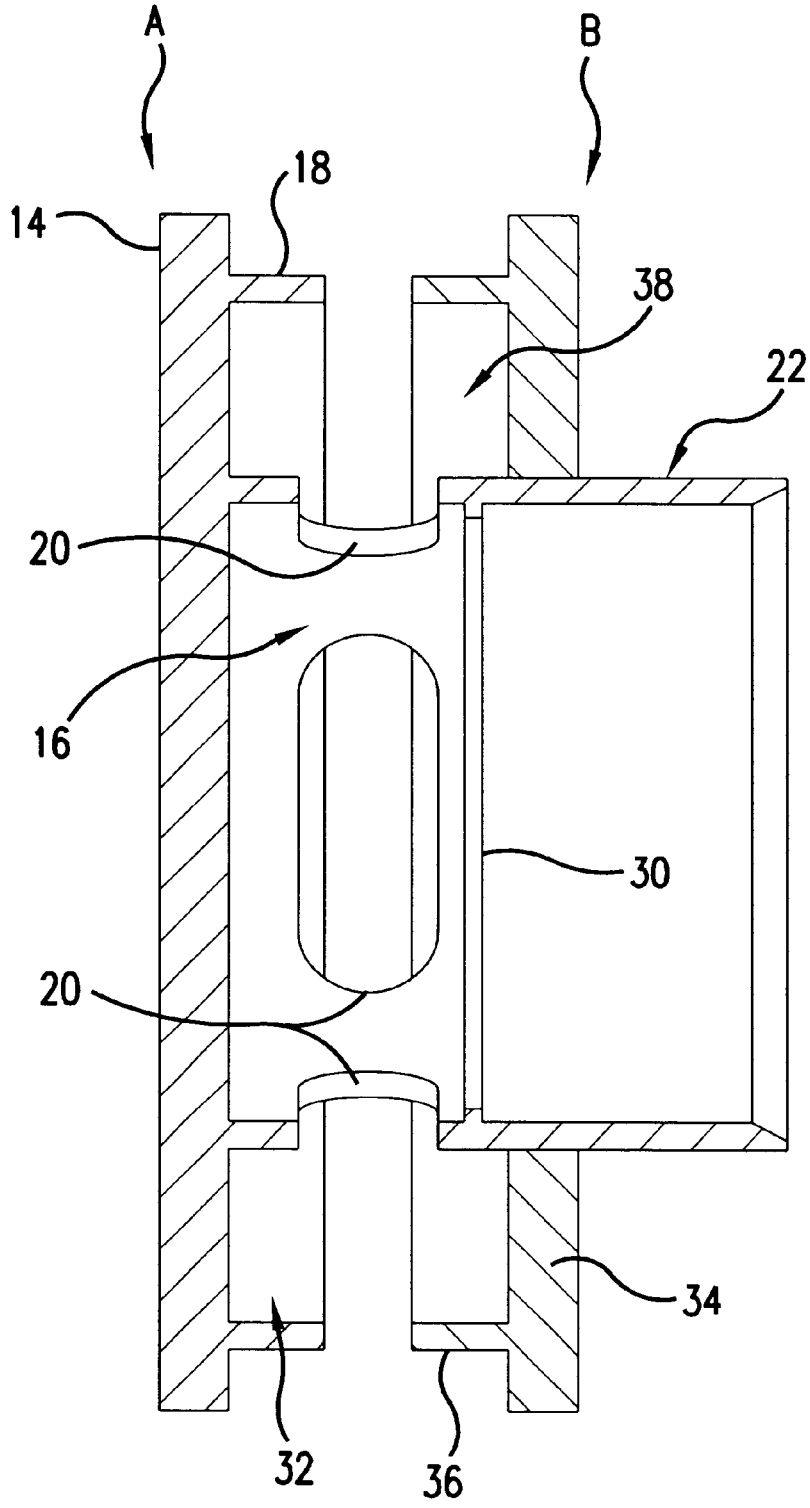
FIG. 2 shows a cross-section of the drainage unit according to the invention.

In the preferred embodiment, retainer B is comprised of a rear flange disc 34 that includes a discharge opening 40. As shown in FIG. 2, discharge extension 22 is inserted through discharge opening 40 so that sheet drain 10 is disposed between front flange disc 14 and rear flange disc 34. Rear flange disc 34 of retainer B also includes a rear sealing ring 36 that extends horizontally from rear flange disc 34 to space the disc from a rear exterior side 28 of sheet drain 10 in order to create a rear fluid collection chamber, designated generally as 38, around the drain hub on the exterior side of the sheet drain. As with front fluid collection chamber 32, fluid channels 20 extend beyond the thickness of the sheet drain to channel water from rear fluid collection chamber 38 into the drain hub so that water which flows back out of the sheet drain into the fluid collection chamber is channeled back into the drain hub for discharge, and does not travel down the face of the retaining wall where it may cause damage to the structure.

In the preferred embodiment, front sealing ring 18 and said rear sealing ring 36 have a diameter greater than the drain hub to create the fluid collection chambers on the front and rear exterior sides of the sheet drain around the drain hub so that an increased area of water collection is provided for channeling water into the drain hub for discharge through the retaining wall. Because the material covering the shaped core of the sheet drain is porous, water often flows back out of the sheet drain into the surrounding soil as it works its way down the face of the retaining wall. By allowing the fluid collection chambers around the outside of the sheet drain to be in fluid communication with fluid channels 20, water that does flow out of the sheet drain into the fluid collection chambers is still collected and channeled into the drain hub. Additionally, as water levels rise behind the retaining wall to the level of the drainage unit, water which is forced out of the sheet drain into the fluid collection chambers is directed through, fluid channels 20 and into the drain hub for discharge. Preferably, the fluid collection chambers provide a water collection and discharge capacity equal to the diameter of the drain hub. For example, in the preferred embodiment where the drain hub is approximately 3" in diameter and the sheet drain is approximately ⅜" in thickness, the fluid collection chambers would be approximately 6" in diameter and spaced ⅜" to ½" from the front and rear exterior sides of the sheet drain by front sealing ring 18 and rear sealing ring 36.

In use, the drainage unit is installed in sheet drain 10 by cutting a hole in the sheet drain to expose the shaped interior core of the sheet drain for allowing the drainage collector to collect water flowing through the sheet drain. The discharge extension and drain hub of the drainage collector are inserted into the hole so that the drain hub fluid channels 20 are in fluid communication with the exposed interior shaped core of the sheet drain. The drainage collector is sealed against front exterior sides 26 of sheet drain 10 by abutting front sealing ring 18 against the filter fabric covering the shaped core of the sheet drain. Retainer B is slid into position around discharge extension 22 to provide a seal on the rear exterior side 28 of the sheet drain by abutting rear sealing ring 36 against the fitter fabric. Retainer B holds the drain hub and discharge extension in position on the sheet drain to ensure that fluid channels 20 remain in fluid communication with the sheet drain interior. Next, discharge pipe 24 is inserted into discharge extension 22 so that the discharge pipe is in fluid communication with drain hub 16 to discharge water channeled into the drain hub. Construction of the retaining wall is then completed to secure the discharge pipe in position within the retaining wall.

When a discharge pipe is used to connect to the drain hub, the discharge extension includes a pipe stop 30, which prevents the discharge pipe from being inserted to far into the drain hub where it could block the fluid channels from allowing water to enter the drain hub. Referring to FIG. 2, pipe stop 30 is a ridge extending outward from the interior side of the discharge extension to catch the edge of the discharge pipe being inserted in the discharge extension.

While a preferred embodiment of the invention has been described using specific terms, such description is for illustrative purposes only, and it is to be understood that changes and variations may be made without departing from the spirit or scope of the following claims.

What is claimed is:

1. A drainage unit for an earth retaining wall system to provide water drainage from a vertical drainage sheet through the retaining wall to reduce hydrostatic pressure on the retaining wall, said drainage unit comprising:

a drainage collector for attaching to a sheet drain to collect and discharge water that flows into the sheet drain;

a drain hub included in said drainage collector for being mounted in fluid communication with said sheet drain to receive water from said sheet drain and channel the water for discharge;

a discharge extension included in said drainage collector extending from said drain hub for discharging water from said sheet drain flowing through said drain hub; and a retainer having a discharge opening for engaging said discharge extension after passing through said sheet drain and securing said drain hub and discharge extension in position on said sheet drain;

whereby a drainage unit is provided that is firmly attached to a sheet drain to prevent separation of the drainage unit from the sheet drain during construction of the retaining wall, and which relieves hydrostatic pressure by channeling water from behind the retaining wall through the retaining wall.

2. The drainage unit of claim 1 including a fluid channel included in said drain hub for channeling water collected from said sheet drain by said drainage collector into said drain hub.

3. The drainage unit of claim 2 wherein said fluid channel comprises an extended slot formed in said drain hub that creates an opening in said drain hub having a slot length greater than a thickness of said sheet drain so that water located around the outside of the sheet drain within the drainage collector is channeled through said extended slots into said drain hub.

4. The drainage unit of claim 1 wherein said discharge extension is adapted for connecting to a discharge pipe that extends through the retaining wall.

5. The drainage unit of claim 1 wherein said drainage collector includes a front sealing ring for engaging a front exterior side of said sheet drain to restrict debris from entering the drainage collector.

6. The drainage unit of claim 5 wherein said retainer includes a rear sealing ring for engaging a rear exterior side of said sheet drain to restrict debris from entering the drainage collector.

7. The drainage unit of claim 6 wherein said front sealing ring and said rear sealing ring have a diameter greater than said drain hub to create a fluid collection chamber on the front and rear exterior sides of said sheet drain around said drain hub so that an increased area of water collection is provided for channeling water into said drain hub for discharge through the retaining wall.

8. A drainage unit for an earth retaining wall system to provide water drainage from a vertical drainage sheet through the retaining wall to reduce hydrostatic pressure on the retaining wall, said drainage unit comprising:

a drainage collector for being inserted through a sheet drain to collect and channel water that flows into the sheet drain for discharge through the retaining wall;

a front sealing ring carried by said drainage collector for engaging a front exterior side of said sheet drain to restrict debris from entering the drainage collector;

a retainer for engaging said drainage collector after passing through said sheet drain and securing said drainage collector in position on said sheet drain; and a rear sealing ring carried by said retainer for engaging a rear exterior side of said sheet drain to restrict debris from entering the drainage collector;

whereby a drainage unit is provided that is firmly attached to a sheet drain to prevent separation of the drainage unit from the sheet drain during construction of the retaining wall, and which relieves hydrostatic pressure by channeling water from behind the retaining wall through the retaining wall.

9. The drainage unit of claim 8 wherein said drainage collector includes a drain hub for being mounted in fluid communication with said sheet drain to receive and channel water into a discharge pipe that extends through the retaining wall for discharge of the water from behind the retaining wall.

10. The drainage unit of claim 9 wherein said front sealing ring and said rear sealing ring have a diameter greater than said drain hub to create a fluid collection chamber on the front and rear exterior sides of said sheet drain around said drain hub so that an increased area of water collection is provided for channeling water into said drain hub for discharge through the retaining wall.

11. The drainage unit of claim 10 including a plurality of fluid channels included in said drain hub in fluid communication with said sheet drain and said fluid collection chamber for channeling water into said drain hub.

12. The drainage unit of claim 11 wherein each of said fluid channels comprise an extended slot formed in said drain hub that creates an opening in said drain hub having a slot length greater than a thickness of said sheet drain so that water located around the outside of the sheet drain within the drainage collector is channeled through said extended slots into said drain hub.

13. The drainage unit of claim 8 including a discharge extension extending from said drainage collector in fluid communication with said drainage collector for discharging water received from said drainage collector through the retaining wall.

14. The drainage unit of claim 13 wherein said discharge extension is adapted for connecting to a discharge pipe that extends through the retaining wall.

15. A drainage unit for an earth retaining wall system to provide water drainage from a vertical drainage sheet through the retaining wall to reduce hydrostatic pressure on the retaining wall, said drainage unit comprising:

a drainage collector for attaching to a sheet drain to collect and discharge water that flows into the sheet drain;

a drain hub included in said drainage collector to receive water from said sheet drain and channel the water from said sheet drain for discharge;

a plurality of fluid channels included in said drain hub in fluid communication with said sheet drain for channeling water from the sheet drain into said drain hub.

a discharge extension extending from said drain hub through the retaining wall for discharging water from said sheet drain flowing through said drain hub; and a retainer for securing said drain hub and discharge extension in position on said sheet drain;

whereby a drainage unit is provided that is firmly attached to a sheet drain to prevent separation of the drainage unit from the sheet drain during construction of the retaining wall, and which relieves hydrostatic pressure by channeling water from behind the retaining wall through the retaining wall.

16. The drainage unit of claim 15 wherein each of said fluid channels comprises an extended slot formed in said drain hub that creates an opening in said drain hub having a slot length greater than a thickness of said sheet drain so that water located around the outside of the sheet drain within the drainage collector is channeled through said extended slots into said drain hub.

17. The drainage unit of claim 15 wherein said discharge extension is adapted for connecting to a discharge pipe that extends through the retaining wall.

18. The drainage unit of claim 15 wherein said drainage collector includes a front sealing ring for engaging a front exterior side of said sheet drain to restrict soil from entering the drainage collector.

19. The drainage unit of claim 18 wherein said retainer includes a rear sealing ring for engaging a rear exterior side of said sheet drain to restrict soil from entering the drainage collector.

20. The drainage unit of claim 19 wherein said front sealing ring and said rear sealing ring have a diameter greater than said drain hub to create a fluid collection chamber on the front and rear exterior sides of said sheet drain around said drain hub so that an increased area of water collection is provided for channeling water into said drain hub for discharge through the retaining wall.

* * * * *